US010787940B1

(12) United States Patent
Shin

(10) Patent No.: US 10,787,940 B1
(45) Date of Patent: Sep. 29, 2020

(54) DEVICE FOR CONTROLLING LUBRICATION OF ROCKER ARMS OF ENGINE WITH CYLINDER DEACTIVATION FUNCTION

(71) Applicants: Hyundai Motor Company, Seoul (KR); Kia Motors Corporation, Seoul (KR)

(72) Inventor: Seung Woo Shin, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/584,428

(22) Filed: Sep. 26, 2019

(30) Foreign Application Priority Data

Apr. 11, 2019 (KR) ..... 10-2019-0042698

(51) Int. Cl.

| | |
|---|---|
| ***F01L 1/18*** | (2006.01) |
| ***F01M 11/02*** | (2006.01) |
| ***F01M 1/16*** | (2006.01) |
| ***F01M 9/10*** | (2006.01) |
| ***F01L 13/00*** | (2006.01) |

(52) U.S. Cl.
CPC ..... *F01M 1/16* (2013.01); *F01L 1/181* (2013.01); *F01L 13/0005* (2013.01); *F01M 9/101* (2013.01); *F01M 9/103* (2013.01); *F01M 11/02* (2013.01); *F01L 2013/001* (2013.01); *F01L 2810/02* (2013.01)

(58) Field of Classification Search
CPC ..... F01M 1/16; F01M 9/101; F01M 9/103; F01M 11/02; F01L 1/181; F01L 1/18; F01L 13/0005; F01L 2013/001; F01L 2810/02
USPC ..... 123/90.33, 90.36
See application file for complete search history.

(56) References Cited

U.S. PATENT DOCUMENTS

| | | | | |
|---|---|---|---|---|
| 4,523,551 | A * | 6/1985 | Arai | F01L 1/2411 123/90.36 |
| 5,125,373 | A * | 6/1992 | Yamada | F01L 1/18 123/196 M |
| 6,883,484 | B2 * | 4/2005 | Oka | F01L 1/18 123/90.39 |
| 10,526,926 | B2 * | 1/2020 | Andrisani | F01L 13/06 |
| 2011/0067673 | A1 * | 3/2011 | Yoon | F01L 13/06 123/321 |
| 2017/0284236 | A1 * | 10/2017 | Ahmed | F01L 1/24 |
| 2017/0350280 | A1 * | 12/2017 | Ahmed | F01L 1/2411 |

FOREIGN PATENT DOCUMENTS

KR 10-1865738 B1 7/2018

* cited by examiner

*Primary Examiner* — Devon C Kramer
*Assistant Examiner* — Kelsey L Stanek
(74) *Attorney, Agent, or Firm* — Morgan, Lewis & Bockius LLP

(57) ABSTRACT

A device configured for controlling lubrication of rocker arms of an engine with a CDA function, may include valves, wherein the opening/closing state of valves is varied in accordance with an operation state of a vehicle, to which the device is applied, and then, amounts of oil supplied to respective rocker arms are adjusted. Accordingly, the oil pressure and oil pumping capacity of a main gallery may be reduced and then, an enhancement in fuel economy may be achieved. Furthermore, lubrication performance may be secured through an increase in oil supply amount.

5 Claims, 5 Drawing Sheets

DEVICE FOR CONTROLLING LUBRICATION OF ROCKER ARMS OF ENGINE WITH CYLINDER DEACTIVATION FUNCTION

CROSS-REFERENCE TO RELATED APPLICATION

The present application claims priority to Korean Patent Application No. 10-2019-0042698, filed on Apr. 11, 2019 in the Korean Intellectual Property Office, the entire contents of which is incorporated herein for all purposes by this reference.

BACKGROUND OF THE INVENTION

Field of the Invention

The present invention relates to a device configured for controlling lubrication of rocker arms of an engine with a cylinder deactivation (CDA) function, which is configured for achieving an enhancement in fuel economy through variation of an amount of oil supplied to the rocker arms according to whether or not the CDA function is enabled.

Description of Related Art

Rocker arms function to change the direction of force while performing a seesaw motion to open or close an intake valve and an exhaust valve.

For example, such a rocker arm is supported, at an intermediate portion thereof, by a rocker shaft provided at a cylinder head. When one end portion of the rocker arm is lifted upwards, the other end portion of the rocker arm presses an intake valve or an exhaust valve while rotating about the rocker shaft and then, the pressed valve is opened.

Meanwhile, a cam and a valve, which operate in linkage with the rocker arm, are always supplied with oil through oil passages formed at the rocker arm. The amount of oil supplied to the rocker arm is so large as to correspond to about 25% of the total amount of oil.

In connection with this, in the case of a cylinder deactivation (CDA) engine having a CDA function for deactivating operation of some cylinders in accordance with driving conditions, it is unnecessary to supply oil to the deactivated cylinders because the rocker arms of the deactivated cylinders do not move. However, oil is always supplied to all rocker arms, irrespective of whether or not cylinder deactivation is enabled. As a result, an excessive amount of oil is unnecessarily supplied and then, engine power loss occurs, resulting in degradation in fuel economy.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a device configured for controlling lubrication of rocker arms of an engine with a cylinder deactivation (CDA) function, which is configured for achieving an enhancement in fuel economy through variation of an amount of oil supplied to the rocker arms according to whether or not the CDA function is enabled.

In accordance with an aspect of the present invention, the above and other objects may be accomplished by the provision of a device configured for controlling lubrication of rocker arms of an engine with cylinder deactivation including a partition wall mounted in a rocker shaft, to extend in a longitudinal direction of the rocker shaft such that the partition wall divides an internal space of the rocker shaft into a first space and a second space, a shaft oil supply hole formed at the rocker shaft, to communicate with the first space such that the shaft oil supply hole supplies oil supplied from an outside of the rocker shaft, to the first space, a first rocker arm oil supply hole formed at the rocker shaft, to communicate with the first space such that the first rocker arm oil supply hole always supplies oil present in the first space to the rocker arm associated with a cylinder in which the CDA function is disabled, a valve mounted between the first space and the second space, to perform opening or closing operation such that the valve selectively supplies oil present in the first space to the second space in accordance with the opening/closing operation thereof, and a second rocker arm oil supply hole formed at the rocker shaft, to communicate with the second space such that the second rocker arm oil supply hole selectively supplies oil present in the second space to the rocker arm associated with a cylinder in which the CDA function is enabled.

The valve may be mounted at the partition wall.

The valve may be a check valve configured to be opened when an oil pressure of the first space is equal to or greater than a predetermined pressure.

The partition wall may be formed to have a plate shape, and may extend in a longitudinal axis of the rocker shaft such that the first space and the second space are formed at a first side and a second side of the partition wall, respectively.

The first rocker arm oil supply hole may be formed to extend between the first space and the rocker arm of the CDA-disabled cylinder. The second rocker arm oil supply hole may be formed to extend between the second space and the rocker arm of the CDA-enabled cylinder.

In accordance with the above-described configurations, the opening/closing state of the valves may be varied in accordance with an operation state of the vehicle and then, the amount of oil supplied to the rocker arms of the deactivated cylinders and the amount of oil supplied to the rocker arms of the activated cylinders may be adjusted.

Accordingly, in an engine operation range unnecessary to supply a large amount of oil, the amount of supplied oil may be reduced, reducing the oil pressure and oil pumping capacity of the main gallery. As a result, engine power loss may be reduced, achieving an enhancement in fuel economy. Furthermore, in an engine operation range requiring a large amount of oil for lubrication, the amount of supplied oil may be increased, securing lubrication performance. As a result, durability of elements may be secured.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
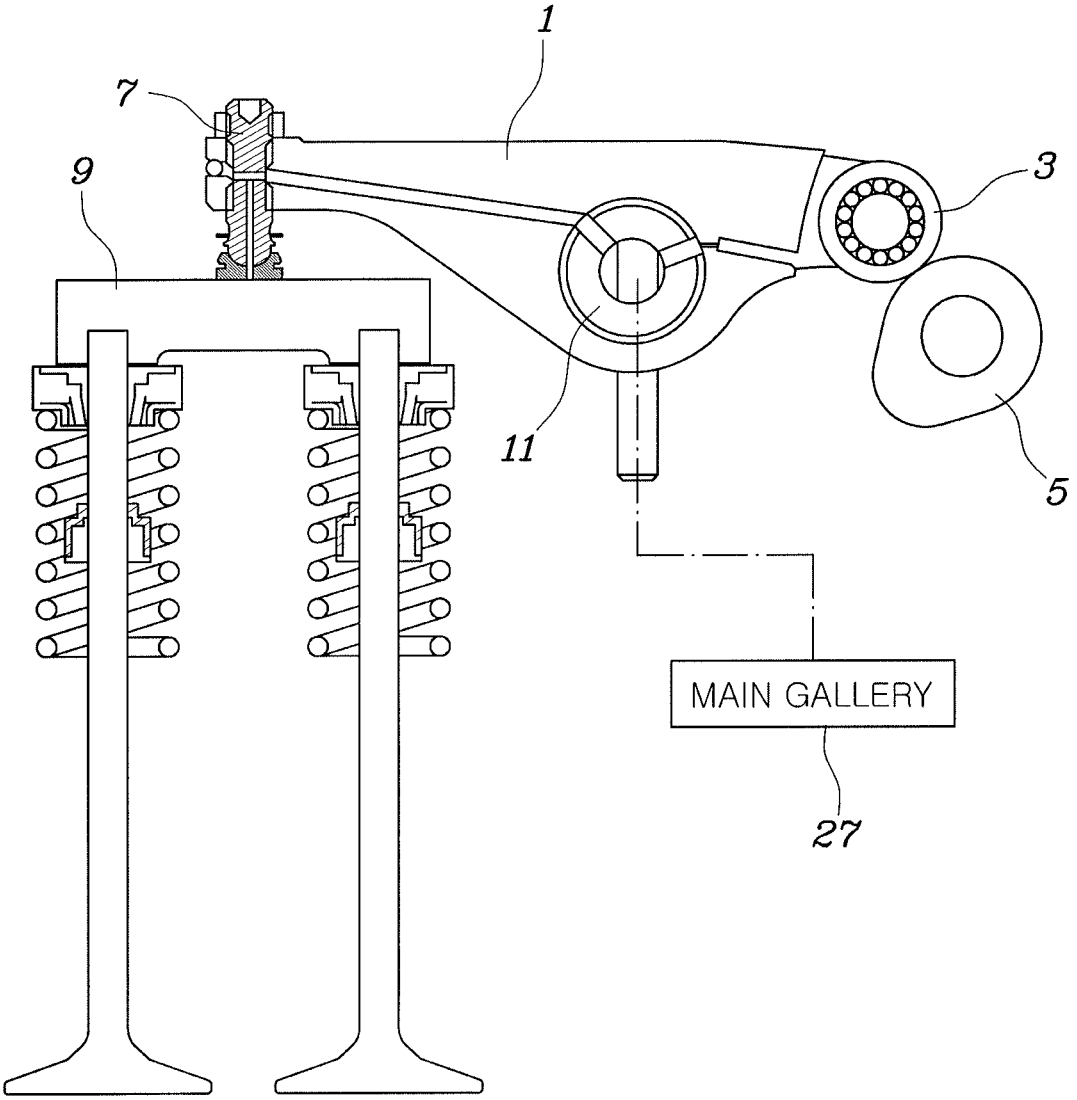
FIG. 1 is a view exemplarily illustrating a configuration of a valve system, to which an exemplary embodiment of the present invention is applicable.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Reference will now be made in detail to the exemplary embodiments of the present invention, examples of which are illustrated in the accompanying drawings. Wherever possible, the same reference numbers will be used throughout the drawings to refer to the same or like parts.

Hereinafter, a configuration of a valve system, to which an exemplary embodiment of the present invention is applied, will be described with reference to FIG. 1. Referring to FIG. 1, a roller pin 3 is rotatably mounted to one end portion of a rocker arm 1. A cam 5 is in contact with the roller pin 3 at an external peripheral surface thereof. Accordingly, the rocker arm 1 rotates in a seesaw manner in accordance with rotation of the cam 5. Thus, valve timing, lift and duration are determined in accordance with a cam profile of the cam 5.

A screw 7 is fixedly fitted, at an intermediate portion thereof, in the other end portion of the rocker arm 1. A valve bridge 9 is supported by a lower end portion of the screw 7. An intake valve or an exhaust valve (hereinafter, collectively referred to as a "valve") is mounted at a lower end portion of the valve bridge 9 such that the valve is opened when pressed by the valve bridge 9.

A valve spring is provided at each valve such that the valve spring surrounds the valve. The valve is returned to an original position thereof by elastic recovery force of the valve spring and then, is closed.

Meanwhile, in an exemplary embodiment of the present invention, when oil is supplied from a main gallery 27 to a rocker shaft 11 (FIG. 2 and FIG. 3), the oil supplied to the rocker shaft 11 is supplied to the rocker arm 1, and is then transferred to the cam 5 and each valve via oil passages formed at the rocker arm.

In connection with this, it is necessary to vary the amount of oil supplied from the rocker shaft 11 to the rocker arm 1 in accordance with driving conditions of a vehicle, to which the valve system is applied, to prevent supply of oil from being unnecessarily excessive.

To the present end, various aspects of the present invention are directed to providing a configuration including a partition wall 13, shaft oil supply holes 21, first rocker arm oil supply holes 23, valves 19 and second rocker arm oil supply holes 25, which are provided within the rocker shaft 11.

Figure 2:
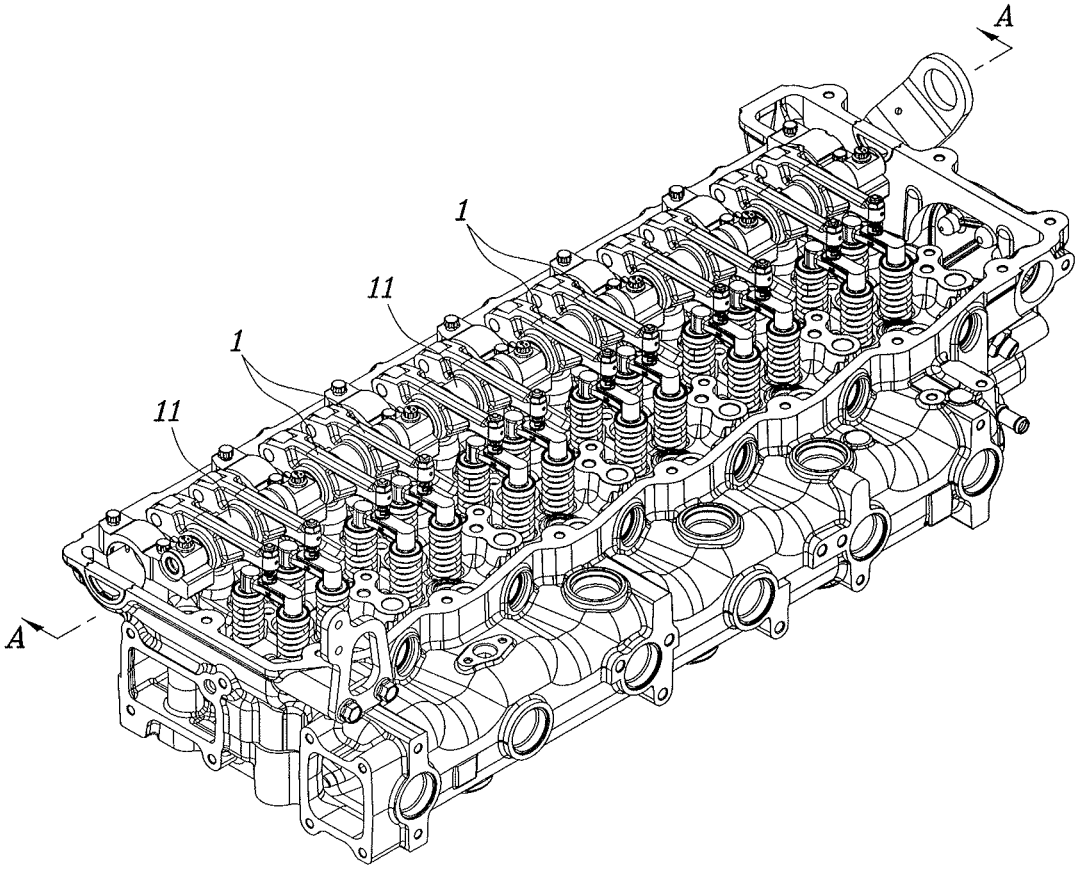
FIG. 2 is a view exemplarily illustrating a state in which rocker arms and a rocker shaft according to an exemplary embodiment of the present invention are coupled to a cylinder head.
Figure 3:
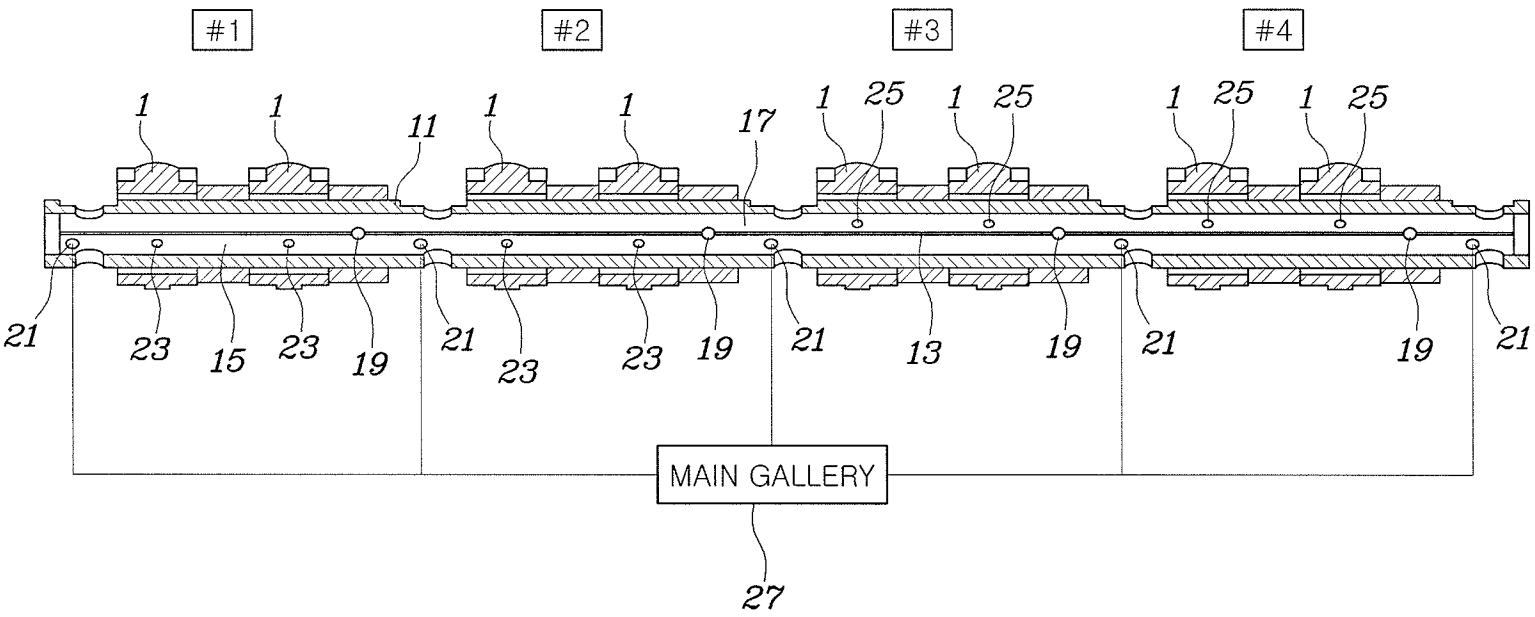
FIG. 3 is a cross-sectional view taken along line A-A of FIG. 2.

Referring to FIG. 2 and FIG. 3, rocker arms 1 are fitted around the rocker shaft 11. The partition wall 13 extends in a longitudinal direction within the rocker shaft 11 and then, the internal space of the rocker shaft 11 includes a first space 15 and a second space 17.

The shaft oil supply holes 21 are formed at the rocker shaft 11 to communicate with the first space 15 and then, supplies, to the first space 15, oil supplied from the main gallery mounted at the outside of the rocker shaft 11.

Meanwhile, the first rocker arm oil supply holes 23 are formed to communicate with the first space 15 to always supply oil present in the first space 15 to the rocker arms 1 associated with cylinders having no cylinder deactivation (CDA) function.

The valves 19 are mounted between the first space 15 and the second space 17, to perform opening/closing operation. In accordance with opening/closing operation of the valves 19, oil present in the first space 15 is selectively supplied to the second space 17.

In the instant case, each valve 19 may be mounted at the partition wall 13. Each valve 19 may be a check valve configured to be opened when the pressure of oil present in the first space 15 is equal to or greater than a predetermined pressure.

Of course, the check valve is only an example of the valve. As the valve, a valve opened or closed under control of a controller may be employed in place of the check valve. In the instant case, driving conditions of an engine in the vehicle may be input to the controller and then, the controller may control opening/closing of the valve through determination of a load range of the vehicle or a cylinder deactivation state.

In addition, the term "controller" refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention.

Meanwhile, the second rocker arm oil supply holes 25 are formed to communicate with the second space 17 to selectively supply the rocker arms 1 associated with cylinders having a CDA function.

That is, when the valves 19 are opened, oil present in the first space 15 is supplied to the second space 17 and then, is supplied to the rocker arms 1 associated with the second rocker arm oil supply holes 25. However, when the valves 19 are closed, oil present in the first space 15 cannot be supplied to the second space 17. As a result, oil cannot be supplied to the rocker arms 1 through the second rocker arm oil supply holes 25.

For example, a plurality of rocker arms 1 may be mounted for each cylinder to transmit cam motion to intake and exhaust valves of the cylinder. Assuming that, in the case of a 4-cylinder engine, a CDA function is enabled in a cylinder #1 and a cylinder #2 while being disabled in a cylinder #3 and a cylinder #4, oil present in the first space 15 may be always supplied to the rocker arms 1 which transmit cam motion to the intake and exhaust valves of the cylinders #3 and #4.

On the other hand, oil present in the second space 17 may be selectively supplied to the rocker arms 1 of the cylinders #1 and #2, in which a CDA function is enabled.

Here, the CDA function is a well-known technology and then, no detailed description will be given of a configuration for deactivating cylinders through a CDA function and an operation principle thereof.

In accordance with the above-described configuration, whether or not cylinder deactivation may be performed is controlled in accordance with an operation range of the vehicle. When some cylinders are deactivated in a low load range, the oil pressure of the first space 15 is relatively low even though the first space 15 is filled with oil. In the instant case, the oil pressure of the first space 15 is lower than an opening pressure of the check valves and then, the check valves are closed.

As a result, oil cannot be introduced into the second space 17 and then, oil cannot be supplied to the rocker arms 1 of the deactivated cylinders connected to the second space 17, whereas oil present in the first space 15 may be supplied to the rocker arms 1 of the cylinders operating normally.

On the other hand, in a high load range, all cylinders operate without presence of any deactivated cylinder and then, the oil pressure of the first space 15 is relatively high as the first space 15 is filled with oil. Since the oil pressure of the first space 15 is higher than the opening pressure of the check valves and then, the check valves are opened.

As a result, oil may be supplied to the rocker arms 1 of all cylinders connected not only to the first space 15, but also to the second space 17.

Figure 4:
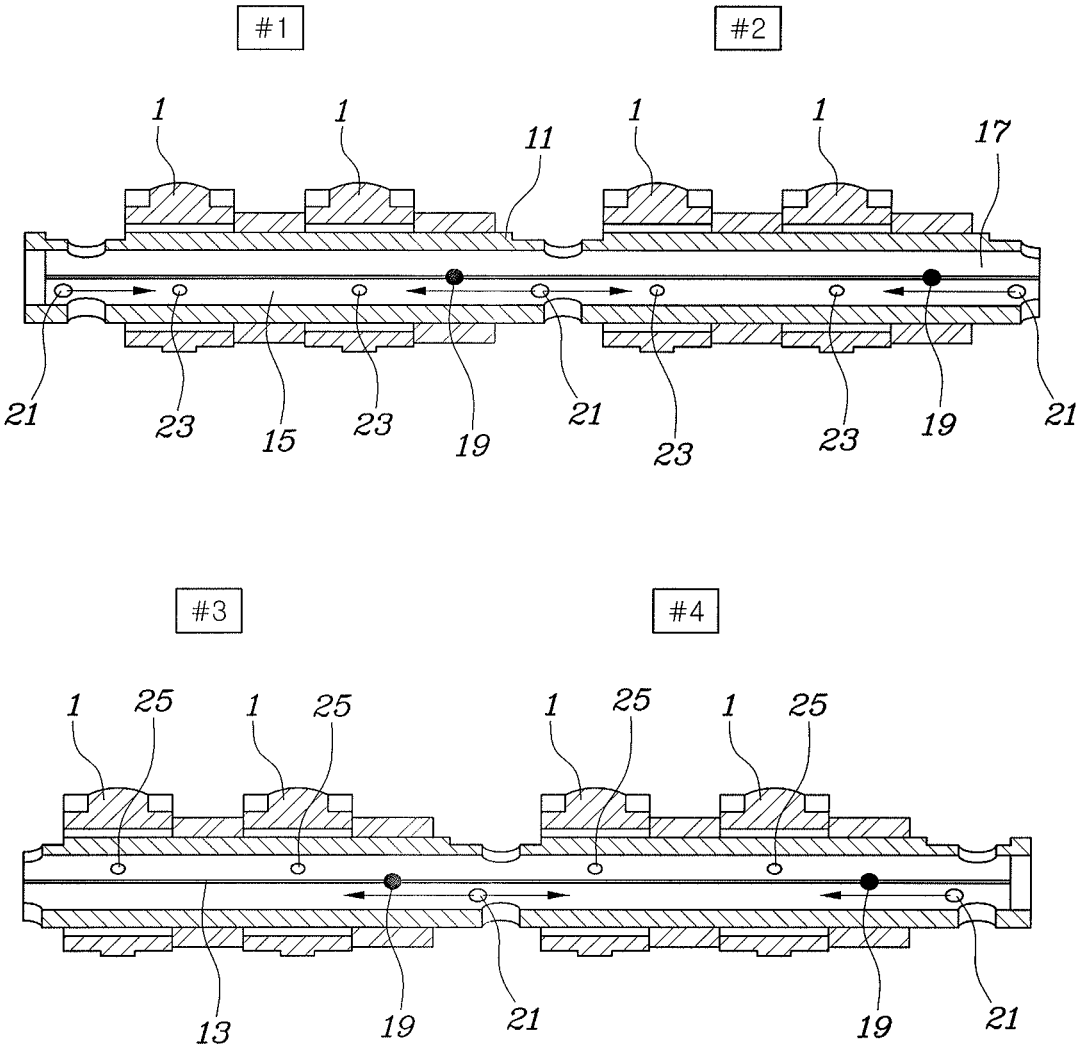
FIG. 4 is a view explaining flow of oil supplied to the rocker arms when a cylinder deactivation (CDA) function is enabled.
Figure 5:
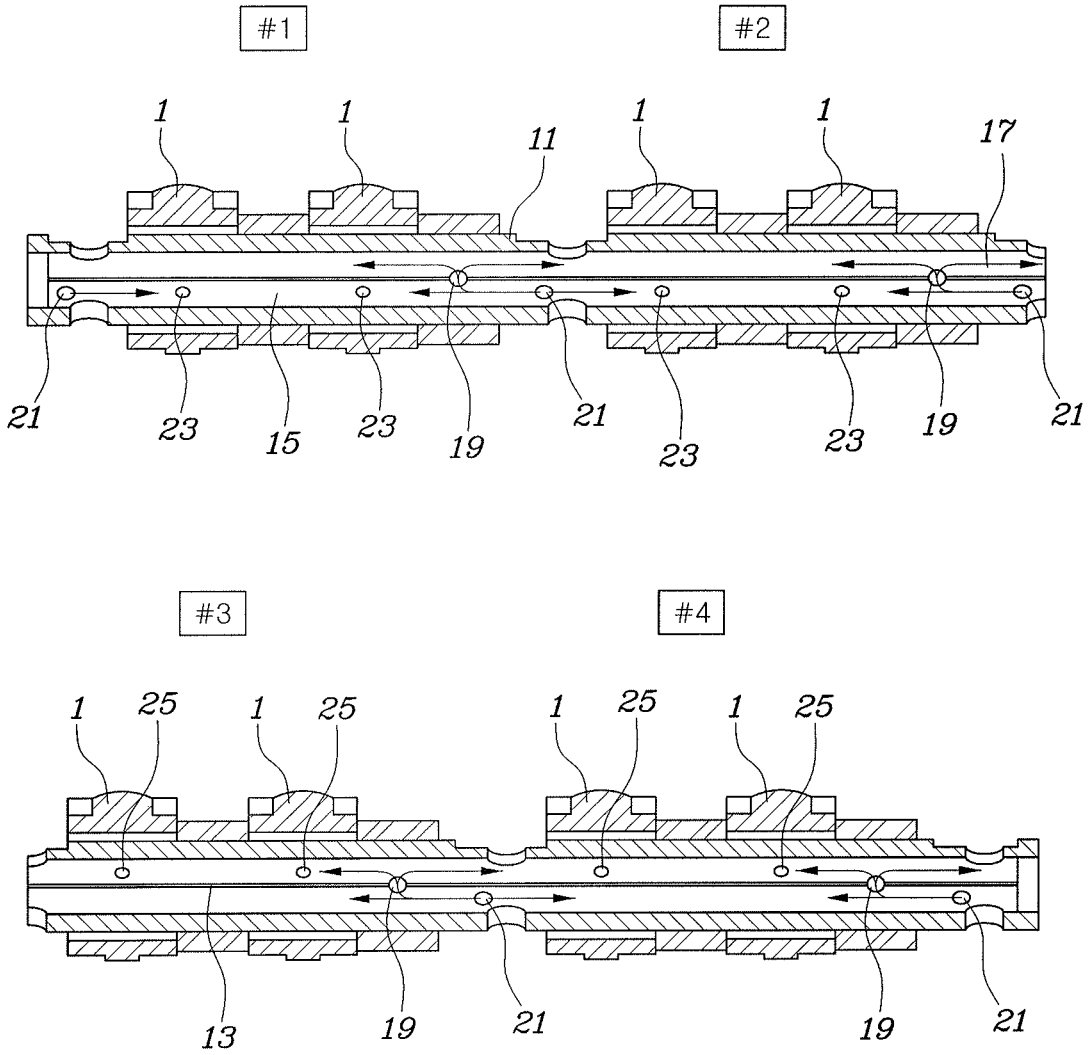
FIG. 5 is a view explaining flow of oil supplied to the rocker arms when the CDA function is disabled.

Referring to FIG. 3, FIG. 4, and FIG. 5, the partition wall 13 is formed to have a plate shape, and extends in a longitudinal axis of the rocker shaft 11 such that the first space 15 and the second space 17 may be formed at a first side and a second side of the partition wall 13.

For example, the first space 15 may be formed under the partition wall 13, and the second space 17 may be formed above the partition wall 13.

Meanwhile, each first rocker arm oil supply hole 23 may be formed to extend between the first space 15 and the rocker arm 1 of a corresponding one of the CDA-disabled cylinders.

That is, each first rocker arm oil supply hole 23 has one end portion connected to the first space 15 and the other end portion formed to extend toward the rocker arm 1 of the corresponding CDA-disabled cylinder.

Furthermore, each second rocker arm oil supply hole 25 may be formed to extend between the second space 17 and the rocker arm 1 of a corresponding one of the CDA-enabled cylinders.

That is, each second rocker arm oil supply hole 25 has one end portion connected to the second space 17 and the other end portion formed to extend toward the rocker arm 1 of the corresponding CDA-enabled cylinder.

Hereinafter, oil supply operation in a state in which a CDA function is enabled in accordance with driving of the vehicle in a low load range will be described. In a state in which a CDA function is enabled, cylinders #1 and #2 are activated to operate normally, and cylinders #3 and #4 are deactivated. in the instant state, oil is supplied to the first space 15 formed under the rocker shaft 11 through the shaft oil supply holes 21.

In the instant case, the first rocker arm oil supply holes 23 respectively disposed to correspond to the cylinders #1 and #2 are formed to communicate with the first space 15, together with the shaft oil supply holes 21, and then, oil introduced into the first space 15 through the shaft oil supply holes 21 is supplied to the rocker arms 1 of the cylinders #1 and #2 while being discharged through the first rocker arm oil supply holes 23.

However, the second rocker oil supply holes 25 respectively disposed to correspond to the cylinders #3 and #4 are formed to communicate with the second space 17, differently from the shaft oil supply holes 21. In the low load range, the pressure of oil supplied to the rocker shaft 11 is relatively low and then, the check valves are in a closed state. The oil supplied to the first space 15 through the shaft oil supply holes 21 cannot be supplied to the second space 17. As a result, no oil is supplied to the rocker arms 1 of the cylinders #3 and #4.

Hereinafter, oil supply operation in a state in which a CDA function is disabled in accordance with driving of the vehicle in a high load range will be described with reference to FIG. 5. In a state in which a CDA function is disabled, not only the cylinder #1 and the cylinder #2, but also the cylinder #3 and the cylinder #4, are activated to operate normally. in the instant state, oil is supplied to the first space 15 formed under the rocker shaft 11 through the shaft oil supply holes 21.

In the instant case, the first rocker arm oil supply holes 23 respectively disposed to correspond to the cylinders #1 and #2 are formed to communicate with the first space 15, together with the shaft oil supply holes 21, and then, oil introduced into the first space 15 through the shaft oil supply holes 21 is supplied to the rocker arms 1 of the cylinders #1 and #2 while being discharged through the first rocker arm oil supply holes 23.

Meanwhile, although the second rocker oil supply holes 25 respectively disposed to correspond to the cylinders #3 and #4 are formed to communicate with the second space 17, differently from the shaft oil supply holes 21, the pressure of oil supplied to the rocker shaft 11 is relatively high in the high load range and then, the check valves are in an opened state. Accordingly, the oil supplied to the first space 15 through the shaft oil supply holes 21 is supplied to the second space 17. As a result, oil is also supplied to the rocker arms 1 of the cylinders #3 and #4.

As apparent from the above description, the opening/closing state of the valves 19 is varied in accordance with an operation state of the vehicle and then, the amount of oil supplied to the rocker arms 1 of the deactivated cylinders and the amount of oil supplied to the rocker arms 1 of the activated cylinders may be adjusted.

Accordingly, in an engine operation range unnecessary to supply a large amount of oil, the amount of supplied oil may be reduced, reducing the oil pressure and oil pumping capacity of the main gallery. As a result, engine power loss may be reduced, achieving an enhancement in fuel economy.

Furthermore, in an engine operation range requiring a large amount of oil for lubrication, the amount of supplied oil may be increased, securing lubrication performance. As a result, durability of elements may be secured.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A device for controlling lubrication of rocker arms of an engine with cylinder deactivation (CDA), the device comprising:

a partition wall disposed in a rocker shaft, to extend in a longitudinal axis of the rocker shaft so that the partition wall divides an internal space of the rocker shaft into a first space and a second space in the rocker shaft;

a shaft oil supply hole formed at the rocker shaft, to fluidically-communicate with the first space so that the shaft oil supply hole supplies oil supplied from an outside of the rocker shaft, to the first space;

a first rocker arm oil supply hole formed at the rocker shaft, to fluidically-communicate with the first space so that the first rocker arm oil supply hole continuously supplies oil present in the first space to a rocker arm associated with a cylinder in which CDA function is disabled, among the rocker arms;

a valve mounted between the first space and the second space, wherein the valve is configured to selectively supply the oil present in the first space to the second space in accordance with operation of the valve; and a second rocker arm oil supply hole formed at the rocker shaft, to fluidically-communicate with the second space so that the second rocker arm oil supply hole selectively supplies oil present in the second space to another rocker arm associated with another cylinder in which the CDA function is enabled, among the rocker arms.

2. The device according to claim 1, wherein the valve is mounted at the partition wall.

3. The device according to claim 1, wherein the valve is a check valve configured to be opened when an oil pressure of the first space is equal to or greater than a predetermined pressure.

4. The device according to claim 1, wherein the partition wall is formed to have a plate shape, and extends in the longitudinal axis of the rocker shaft so that the first space and the second space are formed at a first side and a second side of the partition wall in the internal space of the rocker shaft, respectively.

5. The device according to claim 1, wherein the first rocker arm oil supply hole is formed to extend between the first space and the rocker arm of the cylinder in which the CDA function is disabled; and wherein the second rocker arm oil supply hole is formed to extend between the second space and the another rocker arm of the another cylinder in which the CDA function is enabled.

* * * * *